United States Patent [19]

Ohshima et al.

[11] Patent Number: 4,940,639

[45] Date of Patent: Jul. 10, 1990

[54] ZN-NI ALLOY-PLATED STEEL SHEET WITH IMPROVED IMPACT ADHESION

[75] Inventors: Kazuhide Ohshima, Wakayama; Nobukazu Suzuki, Ibaragi, both of Japan

[73] Assignee: Sumitomo Metal Industries, Ltd., Osaka, Japan

[21] Appl. No.: 376,022

[22] Filed: Jul. 6, 1989

[30] Foreign Application Priority Data

Jul. 7, 1988 [JP] Japan ..... 63-169352
Sep. 1, 1988 [JP] Japan ..... 63-219090

[51] Int. Cl.[5] ..... B32B 15/01; B32B 15/18

[52] U.S. Cl. ..... 428/659; 428/658; 428/679; 428/935

[58] Field of Search ..... 428/658, 659, 679, 935

[56] References Cited

U.S. PATENT DOCUMENTS 4,159,230 6/1979 Barnes et al. ..... 428/658
4,411,961 10/1983 Tremmel ..... 428/679

FOREIGN PATENT DOCUMENTS 204196 11/1983 Japan ..... 428/679
75584 4/1985 Japan ..... 428/659
30683 2/1986 Japan ..... 428/659
110791 5/1986 Japan ..... 428/659

*Primary Examiner*—Robert McDowell
*Attorney, Agent, or Firm*—Burns, Doane, Swecker & Mathis

[57] ABSTRACT

A Zn-Ni alloy electroplated steel sheet exhibiting improved corrosion resistance as well as improved adhesion upon impact and resistance to powdering and a manufacturing process therefor are disclosed. The electroplated steel sheet comprises a steel sheet; a thin Zn-Ni alloy electroplated underlayer on at least one side of the steel sheet in which microcracks having a width of 0.01–0.5 μm and covering 10–60% of the surface area of the electrolplated layer are randomly oriented; and a Zn-Ni alloy electroplated toplayer. The underlayer is prepared by dipping the initially electroplated sheet into an acidic solution containing 20 g/l or more of $Ni^{2+}$ and 20 g/l or more of $Zn^{2+}$ with a ratio of $Ni^{2+}/Zn^{2+}$ of 1.0~4.0 at a bath temperature of 40~70° C. for a period of time (T, seconds) of (5~20) ×W (W: weight of electroplated layer in $g/m^2$) without applying an electric current to form an Ni-rich pretreated underlayer.

5 Claims, 5 Drawing Sheets

ZN-NI ALLOY-PLATED STEEL SHEET WITH IMPROVED IMPACT ADHESION

BACKGROUND OF THE INVENTION

This invention relates to steel sheet plated with a Zn-Ni alloy with improved adhesion upon impact as well as improved resistance to powdering while exhibiting improved resistance to corrosion. In particular, the invention relates to a steel sheet electroplated with a Zn-Ni alloy which is especially advantageous when used for outer panes of automobiles.

Recently, there is an increasingly strong demand for automobile bodies having improved corrosion resistance. The so-called "10-5" guideline to the corrosion resistance has been announced for accelerating development of electroplated steel sheet for use in automobiles. It is extremely important to satisfy this guideline. The guideline "10-5" stands for "No perforation for 10 years, and no cosmetic corrosion for 5 years". These two requirements are considered most important, and various types of precoated steel sheets have been developed or proposed to satisfy them. Among these electroplated steel sheets, Zn-Ni alloy-electroplated steel sheets have the best overall characteristics including their improved corrosion resistance and paintability. Due to their superior resistance to perforation corrosion, Zn-Ni alloy-electroplated steel sheets have been used for the inner panels of automobiles.

Generally, panels for automobiles must exhibit good adhesion to paint coatings. Therefore, it is common for an outer panel of an automobile to be disposed with its cold rolled surface facing outwards because the cold-rolled surface is good for paint coating. When an electroplated steel sheet is employed for an outer pane, only one side of the sheet is electroplated and the unplated surface is made to face outwards. However, steel sheet which is electroplated on both sides is becoming increasingly common since the exterior outer panels also needs to be highly corrosion resistant.

The Zn-Ni alloy electroplated steel sheet has the following defects which must be overcome before it can be satisfactorily employed for the outer panels of modern automobiles.

(i) The plating layer of conventional Zn-Ni alloy electroplated steel sheet contains 10–16% by weight of Ni. This level of N is necessary to achieve a satisfactory level of corrosion resistance. However, the plating layer comprises hard intermetallic compounds of a single $\gamma$-phase. Therefore, when the steel sheet is used for the outer panels of automobiles, peeling of the painting layer and even the plating layer can easily occur due to impact with gravel, which often strikes against the outer panels. This peeling under impact is caed "chipping". The precoated steel sheet easily undergoes red rusting in the area where the plating is peeled off. This is an extremely serious drawback, since it is greatly desired the surface of an exterior outer panel of an automobile be kept free of rust.

(ii) Steel sheet is shaped into automobile outer panels by pressing. During press-forming, the hard plating layer of a singe $\gamma$ phase is easily cracked, and the cracked plating layer easily peels off the steel substrate during sliding on the press die, resulting in a degradation in the corrosion resistance without paint.

Thus, in order for conventional Zn-Ni alloy electroplated steel sheet to be used for automobile outer panels, the adhesion of an electroplated layer to the substrate when an impact is applied (hereunder referred to as "impact adhesion"or "adhesion upon impact") and the adhesion of the electroplated layer to the substrate during pressing (hereunder referred to as "adhesion after processing" or "adhesion after forming") must be improved. Some proposals for improving these properties are as follows:

① U.S. Pat. No.3,558,442 specifies certain plating bath conditions including composition, pH. and temperature, as well as the electrolytic conditions including current density for the manufacture of Zn-Ni alloy-electroplating steel sheet.

② A multi-layered electroplating of Zn-Ni alloy is provided, the Ni content of each of the layer being different. The Ni content of a Zn-Ni alloy first layer deposited on a steel substrate is higher or lower than that of a Zn-Ni alloy layer to be placed thereon. See Japanese Patent Kokai 58-204196 and 58-6995.

③ A steel substrate is first flashed with Ni, Cu or the like to form a first ultra-thin layer, and then a predetermined Zn-Ni alloy is plated thereon.

These methods do in fact provide an improvement in the adhesion of Zn-Ni alloy electroplating layer upon impact. However, the level of improvement is still not satisfactory in light of present-day requirements. Furthermore, the resulting steel sheet does not meet requirements for resistance to chipping at low temperatures. i.e., the "low temperature chipping resistance", which is strongly desired in cold regions such as Canada and Northern U.S.A., where peeling of plating often occurs when gravel strikes against the exterior outer panels of automobiles at 100~250 km/hr at a temperature of −20° C.~40° C. Therefore, the term "low temperature chipping resistance" means resistance to peeling by an electroplated layer when struck by flying grave at low temperatures.

Zinc alloy-plated steel sheet does not meet requirements regarding resistance to powdering, either. "Powdering" means the peeling-off of a Zinc alloy-plated layer in a powdery form. Powdering is undesirable because it results in spangle-like (star-shaped) defects on the surface of steel sheet for use in automobiles, electrical appliances, and the like, and because the pressing die must be frequently brushed off to remove the powder.

One of the inventors of the present invention proposed a method of improving adhesion of plating upon impact in Japanese patent application No. 61-51518. In that application, a preformed thin plating is dipped into a plating bath to dissove the plating, and then a Zn-Ni alloy electroplating is applied. This method is effective to improve the adhesion of plating upon impact. However, the resistance to powdering during press forming and the corrosion resistance after press forming are still not completely satisfactory.

Furthermore, in accordance with the flash-plating method described in ③, not only the above-mentined problems but also the occurrence of red rusting after coating are inevitable.

As already mentioned, adhesion upon impact is the adhesion which can keep the plating adhesive to the substrate even when pebbles hit against a steel sheet panel with a coating at a speed of 100~250 km/hr at low temperatures, such as −20° C.~−-40° C. This may also be called the adhesion upon impact dynamic deformation. On the other hand, powdering occurs during press forming and is due to bending and shearing stresses during forming and sliding of a sheet under high pressure against the press die. The resistance to powdering also depends on the adhesion of the electroplating layer to the steel substrate. Therefore, although improvements in impact adhesion and resistance to powdering are required for an electroplated layer, they should be distinguished from each other with respect to not only the shape of the peeled-off pieces from the surface of the sheet but also the mechanism by which they occur. When an impact stress is applied, for example, the peeled-off pieces are in the shape of sliced fine flakes. Thus, different measures are apparently necessary for improving adhesion upon impact and resistance to powdering.

SUMMARY OF THE INVENTION

An object of the present invention is to provide an electroplated steel sheet having not only improved corrosion resistance and paintability but also a satisfactory degree of resistance to peeling-off of the electroplated layer upon impact as well as resistance to powdering during deformation such as press forming.

Another object of the present invention is to provide a process for manufacturing the above-described electroplated steel sheet in an efficient and reliable manner.

The objects of the present invention can be achieved by providing on a steel sheet substrate a thin plating underlayer of a Zn-Ni alloy having a high content of Ni and numerous microcracks on the surface thereof, and applying a Zn-Ni alloy electroplating layer having a rather low content of Ni atop the underlayer.

In particular, when the microcracks in the pretreated underlayer are oriented at random, the average width of the cracks is 0.01~0.5 μm, and the microcracks cover 10~60% of the surface area of the underlayer, then the adhesion of a highly corrosion-resistant Zn-Ni alloy plating toplayer to the steel sheet substrate during and after forming is remarkably improved to a level which is required for automobile outer panels. The percent of the surface area occupied by the cracks will be referred to as the "density" of the microcracks.

Thus, the present invention is a Zn-Ni alloy electroplated steel sheet exhibiting improved corrosion resistance as well as improved adhesion upon impact, which comprises, at least on one side thereof, a thin Zn-Ni alloy electroplated underlayer in which microcracks having a width of 0.01–0.5 μm and a density of 10–60%, are randomly oriented, and a Zn-Ni alloy electroplated toplayer.

In a preferred embodiment of the present invention, the Zn-Ni alloy electroplated steel sheet is manufactured by electroplating at least one surface of the sheet with a $\gamma$-single phase ($Ni_5Zn_{21}$ or $Ni_3Zn_{22}$)) or a ($\gamma+\alpha$)-dual phase of a Zn-Ni alloy in an amount of 0.1~5.0 g/m$^2$, dipping the electroplated sheet into an acidic solution containing 20 g/l or more of $Ni^{2+}$ and 20 g/l or more of $Zn^{2+}$ with a ratio of $Ni^{2+}/Zn^{2+}$ of 1.0~4.0 at a bath temperature of 40~70° C. for a period of time (T, seconds) of (5~20)×W (W: weight of electroplated layer in g/m$^2$) without applying an electric current, and then forming a predetermined Zn-Ni alloy electroplated layer thereon.

Due to the provision of the above-defined thin underlayer between the steel sheet substrate and the Zn-Ni alloy electroplated toplayer, the adhesion of the electroplating layer to the steel sheet as well as the corrosion resistance thereof are markedly improved, resulting in improvements in the adhesion upon impact, resistance to powdering, and corrosion resistance.

The Zn-Ni alloy which can be employed as a topcoating includes not only a Zn-Ni alloy preferably containing about 8–16 % of Ni, but also one containing 0.1~1.0 wt % of Co and/or less than 3.0 wt % of Ti so as to further improve heat resistance and corrosion resistance.

DESCRIPTION OF THE PREFERRED EMBODIMENTS

The Zn-Ni alloy electroplated steel sheet of the invention can be manufactured in the following manner.

A Zn-Ni alloy is electroplated onto one or both sides of a steel sheet. The Zn-Ni alloy preferably contains 9–16% of Ni and is applied in an amount of 0.1~5.0 g/m$^2$ as an extremely thin film, i.e., an underlayer. This is sometimes called "initial electroplating".

In a preferred embodiment, the initial electroplating underlayer comprises a $\gamma$-phase ($Ni_5Zn_{21}$ or $Ni_3Zn_{22}$) or ($\gamma+\alpha$)-phase. The phase structure can be adjusted by controlling the content of Ni in the electroplating bath.

The thus-formed underlayer is then subjected to dipping into a Zn-Ni alloy electroplating acidic bath without applying an electric current, or alternatively it is subjected to an anodic treatment in an electrolytic solution so as to preferentially dissolve Zn of the plating, resulting in the formation of numerous microcracks of random orientation in the plating layer. Thus, an underlayer containing a relatively high content of Ni is prepared for further plating.

A Zn-Ni alloy is then electroplated atop the thus-pretreated underlayer in a conventional manner. The Ni content of an overall Zn-Ni alloy electroplating is preferably 8~16%.

The reasons for the above-described limitations on the amount of plating and the width and density of the microcracks are as follows.

When the amount of the thin underlayer plating is less than 0.1 g/m$^2$, the density of the cracks and the thickness of the underlayer after dissolution of Zn are smaller than those required to achieve a satisfactory level of the impact adhesion and anti-powdering. i.e. resistance to powdering. On the other hand, when the amount is more than 5.0 g/m$^2$, since it takes a long time to form an effective underlayer by dissolution, there is a tendency that not only is productivity decreased, but also that an Ni-rich underlayer is formed to an excessive extent to degrade the bare corrosion resistance.

Preferably, the amount of the underlayer is 0.5~2.0 g/m$^2$.

The presence of microcracks in the underlayer is crucial for improving the adhesion of the plating layer, especially for improving resistance to powdering. When the width of the microcracks is smaller than 0.01 μm, the plating toplayer of Zn-Ni alloy does not adequately penetrate the cracks and a satisfactory improvement in the adhesion of the plating layer to the substrate at the bottom of the crack cannot be obtained On the other hand, when the width is larger than 0.5 μm, the pretreated underlayer will lose its effectiveness for improving adhesion. Preferably, the width is 0.05~0.2μm.

The width of the microcracks can be adjusted by controlling the treating time for dissolving the Zn of the underlayer, i.e., the dipping time into an acid solution and the anodic treatment time.

Figure 1:
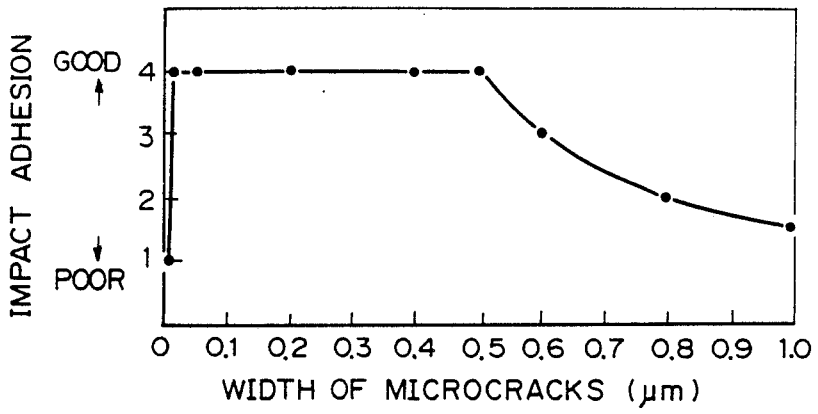
FIG. 1 is a graph showing the relationship between the width of microcracks of the pretreated underlayer and the adhesion upon impact for a Zn-Ni alloy electroplated steel sheet.

FIG. 1 is a graph showing the relationship between the width of the microcracks in the underlayer and the impact adhesion of the electroplating layer. As is apparent from this graph, the adhesion upon impact is rapidly degraded when the crack width is less than 0.01 μm or over 0.5 μm.

The density of cracks. i.e., the percent of the surface area occupied by cracks also has a very important influence on the adhesion of electroplating. When the density is less than 10%, the area where the toplayer of Zn-Ni alloy electroplating penetrates into the cracks is so small that a satisfactory level of anchoring to improve the adhesion upon impact and resistance to powdering cannot be obtained. However, when the density is over 60%, the effectiveness of the underlayer at improving the impact adhesion and the resistance to powdering will be lost. Preferably the density is 20~40%.

The density of the microcracks can be adjusted by controlling the treating time for dissolving the Zn of the underlayer, i.e., by controlling the dipping time into an acid solution and the anodic treatment time. The longer the treating time the higher the density. Therefore, the density of the microcracks can be controlled to be in the range of 10–60% by adjusting the amount of dissolution of the underlayer.

Figure 2:
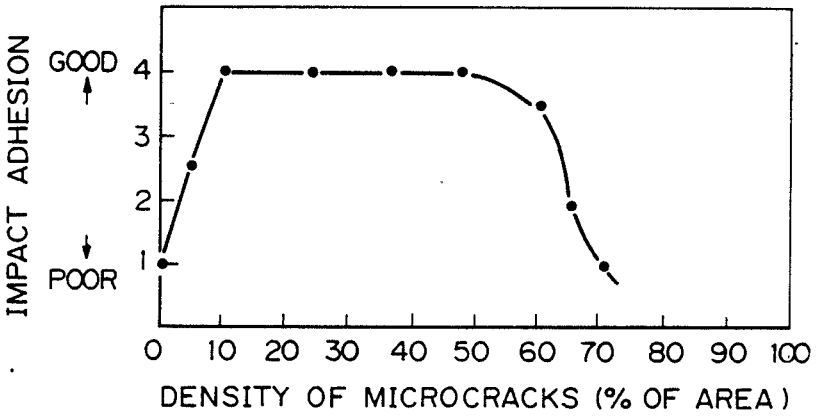
FIG. 2 is a graph showing the relationship between the density of microcracks in the pretreated underlayer and the adhesion upon impact for a Zn-Ni alloy electroplated steel sheet.

FIG. 2 is a graph showing the relationship between the density of the cracks in the underlayer and the adhesion upon impact of the electroplated toplayer. As is apparent therefrom, the impact adhesion is rapidly degraded when the density is less than 10% or over 60%.

It is desirable that the length of the cracks be restricted to 10 μm or less on average for the purpose of further improving the adhesion of the plating. The length can a)so be controlled by adjusting treatment conditions, such as treatment time.

Usually the cracks are branched. Therefore, the term "length of a crack" means the length along the crack between neighboring joints.

In a preferred embodiment of the invention, the pretreatment of the underlayer is carried out without applying an electrical current, i.e., merely by dipping into an acidic solution. The concentrations of $Zn^{2+}$ and $Ni^{2+}$ and the temperature of the dipping bath are controlled so as to have specific values. When the $Ni^{2+}$ concentration is smaller than 20 g/l, a satisfactory level of adhesion upon impact cannot be obtained regardless of the concentration of $Zn^{2+}$. If the $Ni^{2+}$ concentration is 20 g/l or larger, satisfactory adhesion upon impact. i.e., adhesion rated by the rating number "4" can be obtained even when the $Zn^{2+}$ concentration is small, but the resistance to powdering is not so good. Therefore, in order to achieve satisfactory resistance to powdering, it is desired that the $Zn^{2+}$ concentration be also restricted to 20 g/l or more. The upper limit is preferably 80 g/l for each.

It is also preferable that the ratio of $Ni^{2+}/Zn^{+}$ be not more than 4.0. When the ratio is higher than 4.0, the resistance to corrosion of the resulting steel sheet is degraded to such an extent that red rusting easily occurs in a salt spray test for a bare steel sheet, i.e., steel sheet without paint.

FIGS. 1 and 2 show the results of rating of the adhesion of an electroplated layer. The rating was carried out as follows.

Namely, in accordance with ASTM D-3170-74 (test procedures for the impact adhesion), phosphate treatment and three layers of paint coatings for use in automobiles were applied to one side of a test piece (150 mm×100 mm) of steel sheet. The total thickness of the coatings was 100 μm.

Figure 3:
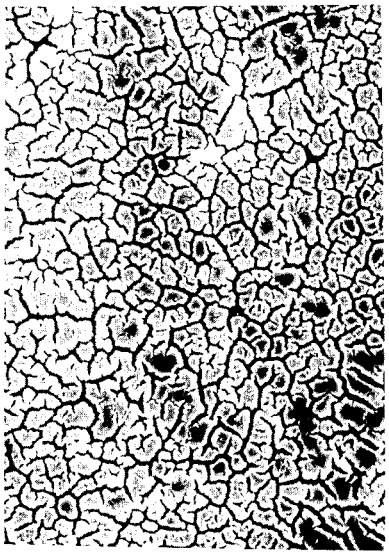
FIG. 3 is an electron micrograph of the pretreated underlayer of the Zn-Ni alloy electroplated steel sheet after dissolution treatment was applied to the thin plating of Zn-Ni alloy in accordance with the present invention.

The Gravelochipping test was carried out on the resulting coated test piece. The results of the test were classified as falling into one of four grades:

4: excellent - no peeling
3: peeling of less than 0.2% of area
2: peeling of less than 1% but not less than 0.2% of area
1: peeling of at least 1% of area FIG. 3 is an electron micrograph of a typical pretreated underlayer of the present invention after dissolving part of Zn preferentially to Ni by dipping a thin electroplated underlayer into the same electroplating bath as for the thin electroplating.

Figure 4:
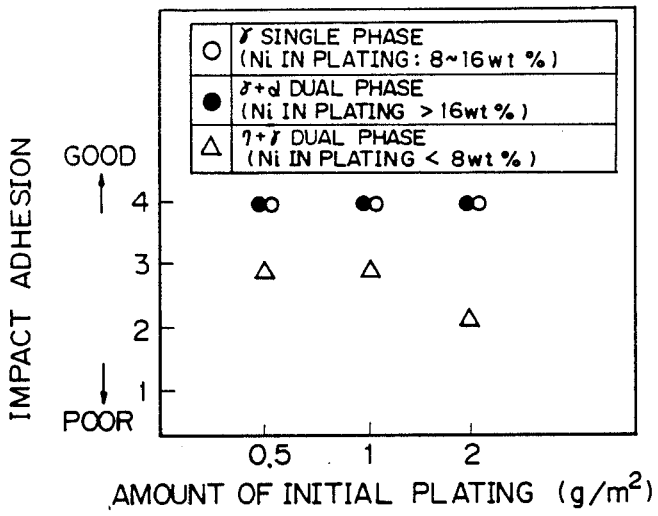
FIG. 4 is a graph showing the relationship between the amount of initial plating of the underlayer and the adhesion upon impact for a Zn-Ni alloy electroplated steel sheet.

FIG. 4 is a graph showing the results of a test for impact adhesion for a Zn-Ni alloy electroplated steel sheet which was first subjected to dissolution of the underlayer by dipping into an acidic solution containing of 30 g/l of $Zn^{2+}$, 50 g/l of $Ni^{2+}$ at a pH of 2.0 and a bath temperature of 50° C. for 10 seconds, after which Zn-Ni alloy (Ni: 12 wt %) top electroplating was applied in an amount of 30 g/m$^2$.

The test results were evaluated in the same manner as for FIG. 1.

As is apparent from FIG. 4, the adhesion depends on the phase structure of the pretreated underlayer. If the Zn which is deposited in the underlayer consists of a combined phase of η-phase with γ-phase, which contains a smaller amount of Ni than the single γ-phase, the adhesion upon impact is less than when the Zn deposited in the underlayer contains a single $\gamma$- phase or $(\gamma+\alpha)$ phase. This is because the width and density of the cracks are so large for a combination of $\eta$-phase and $\gamma$-phase that the purposes of the present invention cannot be achieved. The phase structure can be varied by changing the content of Ni in the underlayer.

Figure 5:
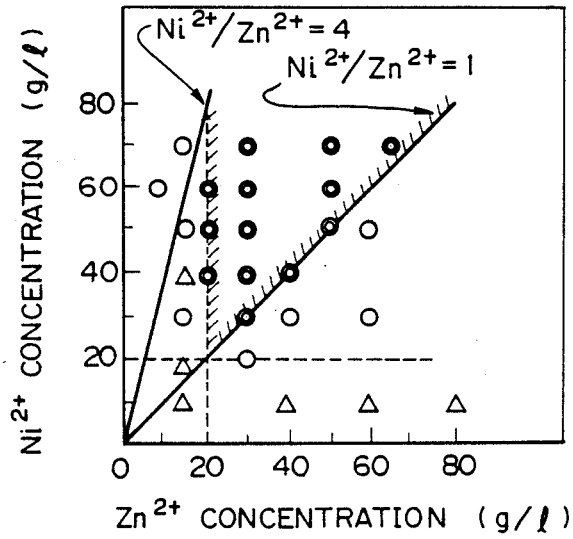
FIG. 5 is a graph showing the relationship between the concentrations of $Ni^{2+}$ and $Zn^{2+}$ in an acidic solution and the impact adhesion for a Zn-Ni alloy electroplated steel sheet.

FIG. 5 shows the results of a test of the adhesion upon impact and the resistance to powdering for a Zn-Ni alloy electroplated steel plate which was prepared by first forming an initial thin plating in an amount of 1 g/m$^2$, dipping the resulting steel plate with a thin plating underlayer into an acidic solution containing various concentrations of $Ni^{2+}$ and $Zn^{2+}$ at a pH of 2.0 at 50° C. for 10 seconds, and then forming a Zn-Ni alloy top-plating (Ni: 12 wt %) in an amount of 30 g/m$^2$ on the pretreated underlayer.

As is apparent from FIG. 5, the preferred ranges for the concentrations of $Ni^{2+}$ and $Zn^{2+}$ are these in which the amounts of $Ni^{2+}$ and $Zn^{2+}$ are not smaller than 20g/l and the ratio of $Ni^{2+}/Zn^{2+}$ is 1.0~4.0.

The impact adhesion was determined in the same manner as for FIGS. 1 and 2. The resistance to powdering was determined as follows.

A disc blank of the electroplated steel plate (90 mm in diameter) was placed in a cup drawing test machine having a punch 50 mm in diameter. Cup drawing was carried out at a drawing ratio of 1.8 to a drawing depth of 30 mm using a blank holder pressurized at 1 ton. After drawing, adhesive tape was paced on the outer surface of the drawn cup and then peeled off the cup to determine the amount of pieces of plating peeled off.

The peeling resistance was evaluated as follows:

4: less than 3 mg of peeled plating per blank piece
3: not less than 3 mg but less than 10 mg of peeled plating per bank piece
2: not less than 10 mg but less than 20 mg of peeled plating per blank piece
1: not less than 20 mg of peeled plating per blank piece.

The overall evaluation given in FIG. 5 of the impact adhesion and the resistance to powdering was made on the basis of following determinations:

: (4, 4)
: (4,3), (4,2), or (3,3)
Δ: (2,2), or (2,3)
X: (1,1), (1,2), (1,3), or (1,4)

The first rating number in the brackets above is for impact adhesion and the second rating number is for anti-powdering.

In addition to the above-mentioned factors, the temperature of the dipping acidic solution has also an influence on the formation of the pretreated underlayer. When the temperature is lower than 40° C., the amount of the underlayer which is dissolved during dipping is so small that the desired underlayer cannot be obtained in an efficient manner. resulting in degradation in adhesion of the electroplated film. However, when the temperature is higher than 70° C., the operating efficiency is decreased. Thus, in a preferred embodiment the temperature of the dipping solution bath is 40~70° C.

Figure 6:
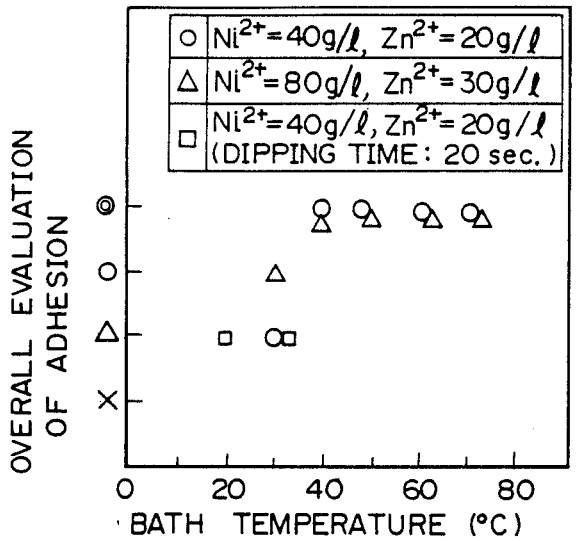
FIG. 6 is a graph showing the relationship between the temperature of an acidic solution for dipping without application of an electric current and an overall evaluation of adhesion including adhesion upon impact and the resistance to powdering.

FIG. 6 is a graph showing the relationship between dipping acidic solution conditions and the adhesion of the electroplated layer including the adhesion upon impact and resistance to powdering for a Zn-Ni alloy electroplated steel sheet which was prepared by forming an initial thin plating in an amount of 1 g/m$^2$, dipping the plate into an acidic solution having a pH of 2.0 for 10 seconds (20 seconds for the case marked by the symbol □) at various bath temperatures, and then forming a Zn-Ni alloy (Ni:12 wt %) electroplating toplayer on the pretreated underlayer. The overall evaluation of adhesion was carried out in the same manner as for FIG. 5.

As is apparent from FIG. 6, when the bath temperature is lower than 30° C., the adhesion of the plating is degraded. As the bath temperature increases the adhesion of the plating increases, and satisfactory results can be obtained at a bath temperature of 40° C. or higher. It was also confirmed that at a lower bath temperature, since the amount of dissolution is small, there is no substantial improvement in adhesion, especially in the resistance to powdering, even if the dipping time is extended. In fact, if electroplated steel sheet which was formed at a low bath temperature with an extended period of dipping is subjected to an impact test, the top layer will peel off the pretreated underlayer.

The neccessary dipping time (T, second) and the amount of initial plating layer (W, g/m$^2$) depend on the bath temperature and the concentrations of $Ni^{2+}$ and $Zn^{2+}$. In a preferred embodiment, in view of the overall characteristics of the electroplated steel sheet including adhesion of the electroplated coating, uniformness in composition of the electroplated coating and corrosion resistance, the ratio of T to W (T/ W) is in the range of 5.0~20.

According to this preferred embodiment, when T/W is smaller than 5.0, the amount of dissolution of the underlayer is so small that a satisfactory level of adhesion cannot be achieved. On the other hand, when T/W is larger than 20, the corrosion resistance decreases.

Figure 7:
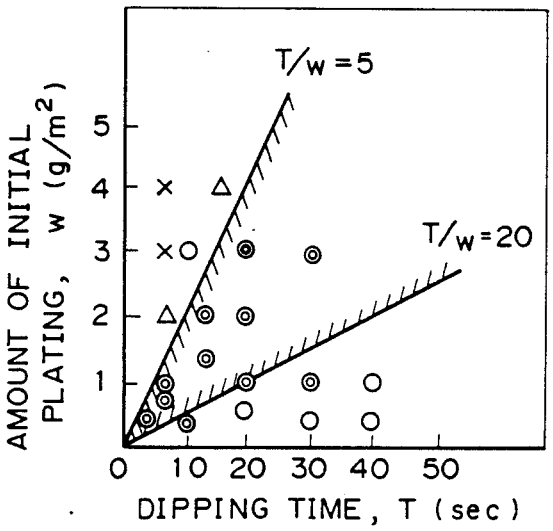
FIG. 7 is a graph showing the relationship between the dipping time (T) as well as the amount of initial electroplating (W) and an overall evaluation of adhesion including adhesion upon impact and resistance to powdering.

FIG. 7 is a graph showing an overall evaluation of the adhesion of plating with respect to the dipping time (T) and the amount of the initial plating film (W). The basis for rating is the same as that used for FIG. 5.

It was confirmed that in a preferred embodiment, T/W is not smaller than 5.0 and the adhesion is satisfactory.

Figure 8:
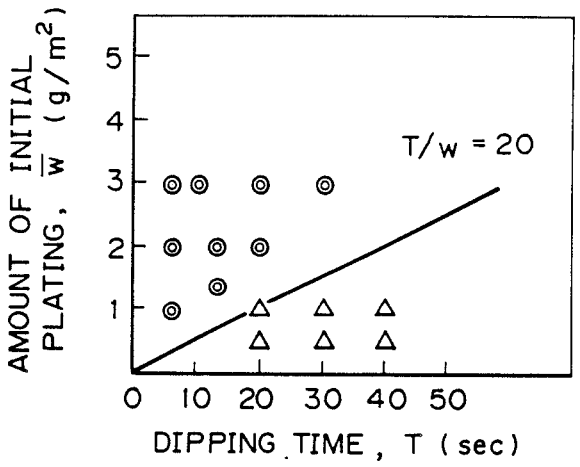
FIG. 8 is a graph showing the relationship between the dipping time (T) as well as the amount of initial electroplating (W) and the corrosion resistance after painting.

FIG. 8 is a graph showing the relationship between the corrosion resistance after painting and the dipping time as well as the amount of the initial plating. The method of evaluation is the same as that will be described later in connection with the working example. From FIG. 8, it can been seen that when T/W is higher than 20, a satisfactory level of corrosion resistance cannot be obtained.

The pretreated underlayer which is obtained by a preferred embodiment of the invention comprises an Ni-rich electroplating layer (Ni:30~80 wt %) and has numerous microcracks, as determined by GDSA (Grimm-Glow Discharge Spectroscopy Analysis) and EPMA (Electron probe Microscope) of the plating section.

In particular, the pretreated underlayer of this type can exhibit excellent properties with respect to the impact adhesion as well as anti-powdering when electroplating of a Zn-Ni alloy top coating using the same treating bath is performed atop the pretreated underlayer. This is because the phase structure of the underlayer comprises a single $\gamma$—phase or a $(\gamma+\alpha)$ dual phase and because a specified pretreatment solution, which is also an electroplating bath, is used under specified conditions.

The pH of the dissolving solution is preferably adjusted to be 1~3, since the formation of $Zn(OH)_2$ or $Ni(OH)_2$ is inevitable at a pH of 5 or higher.

The invention will now be described in further detail in connection with the following working examples.

EXAMPLE 1

A Zn-Ni alloy electroplating bath having the composition shown in Table 1 was prepared. After alkaline degreasing and pickling, a steel plate 0.8 mm thick was subjected to initial electroplating under conditions given in Table 2 to form an underlayer. After the completion of the initial electroplating, the steel plate was dipped into a plating bath which was the same as that used for carrying out the initial plating without the application of an electric current.

Namely, the steel plate was kept in the electroplating bath after the completion of the initial plating without application of an electric current. The underlayer which was pretreated in this manner had numerous microcracks. The width and density of the microcracks are summarized in Table 2.

A Zn-Ni alloy plating with a given thickness was formed atop the pretreated underlayer using the same plating bath as that shown in Table 1. The overall composition of the resulting multiple layer plating is also shown in Table 2.

TABLE 1

| Electroplating Bath | | |
|---|---|---|
| Bath Composition | $Ni^{2+}$ | 50 g/l |
| | $Zn^{2+}$ | 30 g/l |
| | $Na_2SO_4$ | 40 g/l |
| pH | 2.0 | |
| Bath Temperature (°C.) | 50° C. | |

The resulting Zn-Ni alloy electroplated steel plates were evaluated for adhesion upon impact, resistance to powdering, corrosion resistance without paint, and corrosion resistance after painting using the following procedures.

The test results are summarized in Table 2.

Adhesion upon Impact

The test procedures and rating method of evaluation were the same as those for FIGS. 1 and 2.

Resistance to Powdering

Figure 9A:
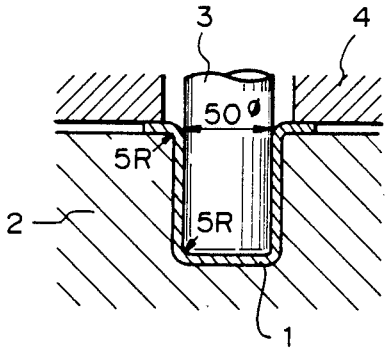
FIG. 9*a* is an illustration of a cup drawing test for evaluating the resistance to powdering.
Figure 9B:
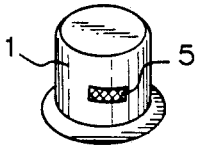
FIG. 9*b* shows where adhesive tape is placed.

The cup drawing test illustrated in FIG. 9*a* was carried out with a drawing ratio of 2 and a drawing depth of 30 mm. After drawing, adhesive tape was placed on the outer wall of the drawn cup as shown in FIG. 9*b*, in which reference numeral 1 is a test piece, 2 is a die, 3 is a punch, 4 is a blank holder, and 5 is the area where the adhesive tape was placed. The resistance to powdering was evaluated in the same manner as previously described in connection with FIG. 5 on the basis of the amount of flakes of the electroplated film which peeled off.

Corrosion Resistance Without Paint

A electroplated steel sheet without paint was subjected to a salt spray test in accordance with JIS Z 2371 for 400 hours. The corrosion resistance without paint was evaluated by measuring the ratio of the area where red rusting occurred to the area free of rust. The following rating were assigned.

4: ratio is 0%.
3: 0% ratio $<$10%.
2: 10%$\leqq$ratio$<$50%
1: ratio$\geqq$50% o

Corrosion resistance after painting

A phosphate treatment was applied to a deformed cup after the cup drawing test, and then a cathodic electrodeposition painting was formed on the deformed cup to a thickness of 20 μm. After scratching the surface of the test piece, the salt spray test described above was performed for 840 hours to determine the formation of blisters and red rusting. The following ratings were assigned.

4: the width of blisters on one side was smaller than 1 mm.
3: the width of blisters on one side was at east 1 and less than 3 mm.
2: the width of blisters on one side was at least 3 and less than 6 mm.
1: the width of blisters on one side was at least 6 mm.

As is apparent from the results shown in Table 2. the Zn-Ni alloy electroplated steel sheet of the present invention has satisfactory adhesion upon impact, resistance to powdering, and corrosion resistance, whereas the comparative example was unsatisfactory with respect to each of these properties. Therefore, as long as the characteristics of the microcracks are within the range of the present invention, a steel sheet having all the desired properties can be manufactured in an efficient manner.

TABLE 2

| Run No. | | Initial Thin Plating (g/m²) | Dipping Time (sec) | Thickness of Underlayer after Dissolution (μm) | Microcracks Width (μm) | Microcracks Density (%) | Overall Plating Deposition (g/m²) | Overall Plating Ni Content (wt %) | Evaluation of Plated Steel Sheet: Impact Adhesion | Anti-Powdering | Corrosion Resist. without Paint | Corrosion Resistance After Painting |
|---|---|---|---|---|---|---|---|---|---|---|---|---|
| Invention | 1 | 0.5 | 5 | 0.05 | 0.1 | 20 | 30 | 12 | 4 | 4 | 4 | 4 |
| | 2 | 1 | | 0.1 | 0.01 | 10 | 30 | 13 | 4 | 4 | 4 | 4 |
| | 3 | | 10 | 0.09 | 0.1 | 40 | 30 | 13 | 4 | 4 | 4 | 4 |
| | 4 | | 20 | 0.08 | 0.5 | 60 | 30 | 13 | 4 | 4 | 4 | 4 |
| Comparative | 5 | | 30 | 0.06 | *0.8 | *70 | 30 | 14 | 3 | 3 | 2 | 3 (Red Rusting) |
| Invention | 6 | 2 | 10 | 0.1 | 0.1 | 40 | 30 | 13 | 4 | 4 | 4 | 4 |
| | 7 | | 20 | 0.15 | 0.2 | 50 | 30 | 13 | 4 | 4 | 4 | 4 |
| | 8 | 5 | | 0.4 | 0.2 | 30 | 30 | 13 | 4 | 4 | 4 | 4 |
| Comparative | 9 | 10 | | 0.8 | *0.005 | *5 | 30 | 12 | 1 | 2 | 4 | 2 |

Note:
*Out of the range of the invention.

Example 2

In this example, Example 1 was repeated except that the initial electroplating was carried out under the conditions shown in Table 3. The resulting initial plating layer was subjected to an anodic treatment in an electrolyte solution under the conditions shown in Table 4.

By controlling the current density and the time for which current was supplied, a pretreated underlayer was obtained having microcracks whose width and density were as shown in Table 3. Subsequent to the formation of such a pretreated underlayer. Zn-Ni alloy electroplating was performed using the same plating bath to obtain a Zn-Ni alloy plating steel sheet having the overall plating composition shown in Table 3.

TABLE 3

| Run No. | | Initial Thin Plating ($g/m^2$) | Electrolytic Dissolution ($C/dm^2$) | Thickness of Underlayer after Dissolution ($\mu m$) | Microcracks Width ($\mu m$) | Microcracks Density (%) | Overall Plating Deposition ($g/m^2$) | Overall Plating Ni Content (wt %) | Evaluation of Plated Steel Sheet: Impact Adhesion | Anti-Powdering | Corrosion Resist. without Paint | Corrosion Resistance After Painting |
|---|---|---|---|---|---|---|---|---|---|---|---|---|
| Invention | 10 | 0.5 | 8 | 0.05 | 0.1 | 20 | 30 | 12 | 4 | 4 | 4 | 4 |
| | 11 | 1.0 | 10 | 0.12 | 0.1 | 30 | 30 | 13 | 4 | 4 | 4 | 4 |
| | 12 | 2.0 | 20 | 0.22 | 0.2 | 30 | 30 | 13 | 4 | 4 | 4 | 4 |
| | 13 | | 30 | 0.21 | 0.2 | 40 | 30 | 13 | 4 | 4 | 4 | 4 |
| | 14 | | 40 | 0.20 | 0.4 | 50 | 30 | 13 | 4 | 4 | 4 | 4 |
| Comparative | 15 | | 60 | 0.20 | *0.6 | 60 | 30 | 14 | 3 | 2 | 2 | 3 (Red Rusting) |
| Invention | 16 | 5.0 | 40 | 0.50 | 0.2 | 40 | 30 | 13 | 4 | 4 | 4 | 4 |

Note:
*Out of the range of the invention.

TABLE 4

| Electrolytic Treatment Conditions | |
|---|---|
| Electrolytic Bath | Aqueous solution of 50 g/l of $Na_2SO_4$ |
| pH | 8.0 |
| Bath Temperature | 50° C. |
| Anodic treatment Time | 1~3 seconds |
| Current Density | 10~100 $A/dm^2$ |

The resulting steel sheet was also subjected to testing to evaluate its impact adhesion, resistance to powdering, corrosion resistance without paint, and corrosion resistance after painting. The test results are summarized in Table 3.

As is apparent from Table 3, it was confirmed that the Zn-Ni alloy electroplated steel sheet of the invention has satisfactory adhesion upon impact, resistance to powdering, and corrosion resistance.

EXAMPLE 3

In this example, Example 1 was repeated using a Zn-Ni electroplating bath under the conditions shown in Table 5. The pretreatment of an underlayer was carried out by dipping the steel plate in the aqueous solution without application of an electric current.

The resulting steel sheet was evaluated with respect to adhesion upon impact, resistance to powdering, corrosion resistance without paint, and corrosion resistance after painting as in Example 1. The test results are summarized in Table 6.

TABLE 5

| Type | Bath Composition, pH, Temperature | |
|---|---|---|
| Type A | $Ni^{2+}$ | 50 g/l |
| | $Zn^{2+}$ | 30 g/l |
| | $Na_2SO_4$ | 40 g/l |
| | pH | 2.0 |
| | Temp. | 50° C. |
| Type B | $Ni^{2+}$ | 80 g/l |
| | $Zn^{2+}$ | 20 g/l |
| | $Na_2SO_4$ | 40 g/l |
| | pH | 2.0 |
| | Temp. | 50° C. |
| Type C | $Ni^{2+}$ | 30 g/l |
| | $Zn^{2+}$ | 40 g/l |
| | $Na_2SO_4$ | 40 g/l |
| | pH | 2.0 |
| | Temp. | 50° C. |

TABLE 6

| Run No. | | Initial Thin Plating: Plating Alloy | Plating Bath | Current Density ($A/dm^2$) | Deposition ($g/m^2$) | Phase Structure (Ni wt %) | Dipping Conditions: $Ni^{2+}$ (g/l) | $Zn^{2+}$ (g/l) | Bath Temp. (°C.) | T/w |
|---|---|---|---|---|---|---|---|---|---|---|
| Invention | 1 | Zn—Ni | Type A | 40 | 0.1 | γ single phase(11) | 50 | | | 7 |
| | 2 | | | | 0.5 | γ single phase(11) | | 20 | 40 | |
| | 3 | | | | 2.0 | γ single phase(11) | 30 | | | 10 |
| | 4 | | | | 5.0 | γ single phase(11) | 70 | 30 | | |
| | 5 | | | 80 | 0.5 | γ single phase(13) | 120 | | 50 | 5 |
| | 6 | | | | 0.5 | γ single phase(13) | | 60 | | |
| | 7 | | | 10 | 0.1 | γ single phase(18) | 50 | 20 | 60 | 20 |
| | 8 | | | 5 | 0.1 | γ + α phase(30) | | | | |
| | 9 | Zn—Ni-0.1% Co | Type A + $Co^{2+}$ | 40 | 2.0 | γ single phase(11) | 40 | 40 | | |
| | 10 | Zn—Ni-0.01% Cr | Type A + $Cr^{6+}$ | | 2.0 | γ single phase(11) | | | 70 | 5 |
| | 11 | | Type B | | 0.5 | γ + α phase(35) | | 30 | 60 | |
| | 12 | | | 80 | 0.5 | γ + α phase(50) | | | | |
| Comparative | 13 | Zn—Ni | Type A | 40 | *0.01 | γ single phase(11) | 50 | | | |
| | 14 | | | | *8.0 | γ single phase(11) | | 20 | 40 | 7 |
| | 15 | | Type C | | 0.5 | *η + α phase(5) | | | | |
| | 16 | | Type A | | *0.01 | γ single phase(11) | 20 | 40 | *30 | 10 |
| | 17 | | | 80 | 0.5 | γ single phase(13) | 50 | 20 | 40 | *30 |
| | 18 | | | | 0.5 | γ single phase(13) | | | | *2 |
| | 19 | Without Initial Thin Plating + Dipping | | | | | | | | |

Thickness of

TABLE 6-continued

| Run No. | | Underlayer after Dissolution (μm) | Microcracks Width (μm) | Microcracks Density (%) | Overall Plating Deposition ($g/m^2$) | Overall Plating Ni Content (wt %) | Evaluation of Plated Steel Sheet: Impact Adhesion | Anti-Powdering | Corrosion Resistance without Paint | Corrosion Resistance After Painting |
|---|---|---|---|---|---|---|---|---|---|---|
| Invention | 1 | 0.01 | 0.1 | 30 | 30 | 12 | 4 | 4 | 4 | 4(No Red Rusting) |
| | 2 | 0.05 | 0.05 | 30 | 30 | 12 | 4 | 4 | 4 | 4(No Red Rusting) |
| | 3 | 0.2 | 0.2 | 40 | 30 | 12 | 4 | 4 | 4 | 4(No Red Rusting) |
| | 4 | 0.5 | 0.3 | 50 | 30 | 13 | 4 | 4 | 4 | 4(No Red Rusting) |
| | 5 | 0.05 | 0.01 | 20 | 30 | 14 | 4 | 4 | 4 | 4(No Red Rusting) |
| | 6 | 0.05 | 0.2 | 50 | 30 | 14 | 4 | 4 | 4 | 4(No Red Rusting) |
| | 7 | 0.01 | 0.3 | 55 | 30 | 14 | 4 | 4 | 4 | 4(No Red Rusting) |
| | 8 | 0.01 | 0.3 | 60 | 30 | 14 | 4 | 4 | 4 | 4(No Red Rusting) |
| | 9 | 0.1 | 0.1 | 40 | 40 | 13 | 4 | 4 | 4 | 4(No Red Rusting) |
| | 10 | 0.1 | 0.2 | 50 | 40 | 13 | 4 | 4 | 4 | 4(No Red Rusting) |
| | 11 | 0.05 | 0.05 | 30 | 30 | 13 | 4 | 4 | 4 | 4(No Red Rusting) |
| | 12 | 0.05 | 0.05 | 40 | 40 | 13 | 4 | 4 | 4 | 4(No Red Rusting) |
| Comparative | 13 | 0.001 | 0.6* | 70* | 30 | 12 | 2 | 2 | 3 | 3 |
| | 14 | 0.8 | 0.005* | 5* | 30 | 12 | 3 | 2 | 2 | 2(Marked Red Rusting) |
| | 15 | 0.05 | 0.005* | 5* | 30 | 11 | 3 | 3 | 4 | 3 |
| | 16 | 0.001 | 0.6* | 60 | 30 | 11 | 2 | 3 | 4 | 3 |
| | 17 | 0.05 | 0.6* | 80* | 30 | 12 | 4 | 3 | 2 | 1(Marked Red Rusting) |
| | 18 | 0.05 | 0.005* | 5* | 30 | 12 | 2 | 3 | 4 | 3 |
| | 19 | 0.05 | 0* | 0* | 30 | 12 | 1 | 2 | 4 | 2 |

Note-
T: Dipping Time (sec),
w: Initial Thin Plating,
*: Out of the range of the invention.

What is claimed is:

1. A Zn-Ni alloy electroplated steel sheet exhibiting improved corrosion resistance as well as improved adhesion upon impact and resistance to powdering, comprising a steel sheet; a thin Zn-Ni alloy electroplated underlayer on at least one side of the steel sheet in which microcracks having a width of 0.01–0.5 μm and covering 10–60% of the surface area of the electroplated layer are randomly oriented; and a Zn-Ni alloy electroplated toplayer.

2. A Zn-Ni alloy electroplated steel sheet a set forth in claim 1, wherein the Ni content of the underlayer is 30~80%.

3. A Zn-Ni alloy electroplated steel sheet as set forth in claim 1, wherein the composition of the Zn-Ni electrodeposited toplayer comprises 8~16of Ni with the balance being Zn.

4. A Zn-Ni alloy electroplated steel sheet as set forth in claim 1, wherein the width of the mcirocracks is 0.05~0.2 μm.

5. A Zn-Ni alloy electroplated steel sheet as set forth in claim 1, wherein the microcracks cover 20~40% of the surface area of the underlayer.

* * * * *